United States Patent [19]

Marzoli et al.

[11] Patent Number: 4,988,373

[45] Date of Patent: Jan. 29, 1991

[54] IMPURITY SEPARATOR FOR CLEANING STAPLE COTTON

[76] Inventors: Pietro B. Marzoli; Mario Mascheretti, both of Via Durante, 1, Palazzolo sull'Oglio (BS), Italy

[21] Appl. No.: 432,039

[22] Filed: Nov. 3, 1989

[30] Foreign Application Priority Data

Jun. 1, 1989 [IT] Italy ..... 20726 A/89

[51] Int. Cl.[5] ..... B01D 45/00

[52] U.S. Cl. ..... 55/461; 209/143

[58] Field of Search ..... 55/461; 209/143

[56] References Cited

U.S. PATENT DOCUMENTS

| | | | |
|---|---|---|---|
| 676,969 | 6/1901 | Stebbins | 55/461 |
| 738,745 | 9/1903 | McCord | 55/461 |
| 843,413 | 2/1907 | McKeen, Jr. | 55/461 |
| 1,230,757 | 6/1917 | Morrison | 55/461 |
| 1,818,367 | 8/1931 | wallace | 209/143 |
| 1,945,820 | 2/1934 | Mitchell | 55/461 |
| 2,850,162 | 9/1958 | Widmer | 209/143 |
| 2,917,344 | 12/1959 | Futty | 55/461 |
| 3,096,276 | 7/1963 | Franks et al. | 209/143 |
| 3,354,923 | 11/1967 | Voller | 209/143 |
| 3,360,125 | 12/1967 | Horsey | 209/143 |
| 3,710,561 | 1/1973 | Garrone | 55/461 |
| 4,251,356 | 2/1981 | Harte | 209/143 |
| 4,441,994 | 4/1984 | Beneke et al. | 209/143 |
| 4,481,019 | 11/1984 | Moreno | 209/143 |

FOREIGN PATENT DOCUMENTS

| | | | |
|---|---|---|---|
| 615488 | 2/1961 | Canada | 55/461 |
| 593422 | 5/1959 | Italy | 209/143 |
| 245654 | 8/1947 | Switzerland | 209/143 |

*Primary Examiner*—Jay H. Woo
*Assistant Examiner*—C. Scott Bushey
*Attorney, Agent, or Firm*—Bucknam and Archer

[57] ABSTRACT

The separator, provided for installation in conventional ducts for conveying spinnable material staples to staple processing apparatus has a suitable duct which, at the bottom, opens to a collecting chamber, between this collecting chamber and the duct there being arranged a device to convey textile material to be discarded in a single direction.

1 Claim, 1 Drawing Sheet

IMPURITY SEPARATOR FOR CLEANING STAPLE COTTON

BACKGROUND OF THE INVENTION

The present invention relates to an impurity separator for cleaning staple cotton material or the like textile material.

As is known, cotton processing methods usually comprise a lot of processing steps carried out by specifically designed apparatus to which cotton is conveyed through negative pressure ducts.

Advantageously these conveying ducts include elbow bends, at the bottom portions of which there are provided chambers for collecting dust and not spinnable materials being removed from the cotton staples which are conveyed.

In conventional cotton processing systems, the mentioned collecting chambers are separated from the corresponding conveying or transfer ducts exclusively by means of fixed baffle members.

In this connection reference can be made to the DE 31 09 154 patent disclosing a device for the above mentioned application: in this device, however, already discarded material can be entrained again by the conveying air flow which normally contacts this material.

Thus, the already discarded or waste material is conveyed again to the staple cotton supply duct, with obvious deleterious consequences.

SUMMARY OF THE INVENTION

Accordingly the main object of the present invention is to overcome the above mentioned drawback, by providing an impurity separator, for cleaning staple cotton or the like textile material in which the cotton supply duct is tightly separated from the not spinnable collecting chamber.

Another important object of the present invention is to provide such an impurity separator, for cleaning staple cotton or the like textile material, which also affords the possibility of easily recovering low weight cotton staples possibly conveyed to the mentioned collecting chamber.

Another object of the present invention is to provide such an impurity separator which is adapted to surely prevent not spinnable waste material from being recirculated.

According to one aspect of the present invention, the above mentioned objects, as well as yet other objects which will become more apparent hereinafter, are achieved by an impurity separator for cleaning staple cotton and the like textile material, comprising a cotton staple transfer or conveying duct which, at a bottom portion thereof, opens to a collecting chamber, characterized in that between said conveying duct and collecting chamber there is arranged a device adapted to cause waste material to be conveyed in a single direction.

BRIEF DESCRIPTION OF THE DRAWINGS

Further characteristics and advantages of the impuruty separator according to the present invention will become more apparent from the following detailed description of a preferred embodiment thereof, which is illustrated, by way of an indicative but not limitative example, in the figures of the accompanying drawing, where.

DESCRIPTION OF THE PREFERRED EMBODIMENT

Figure 1:
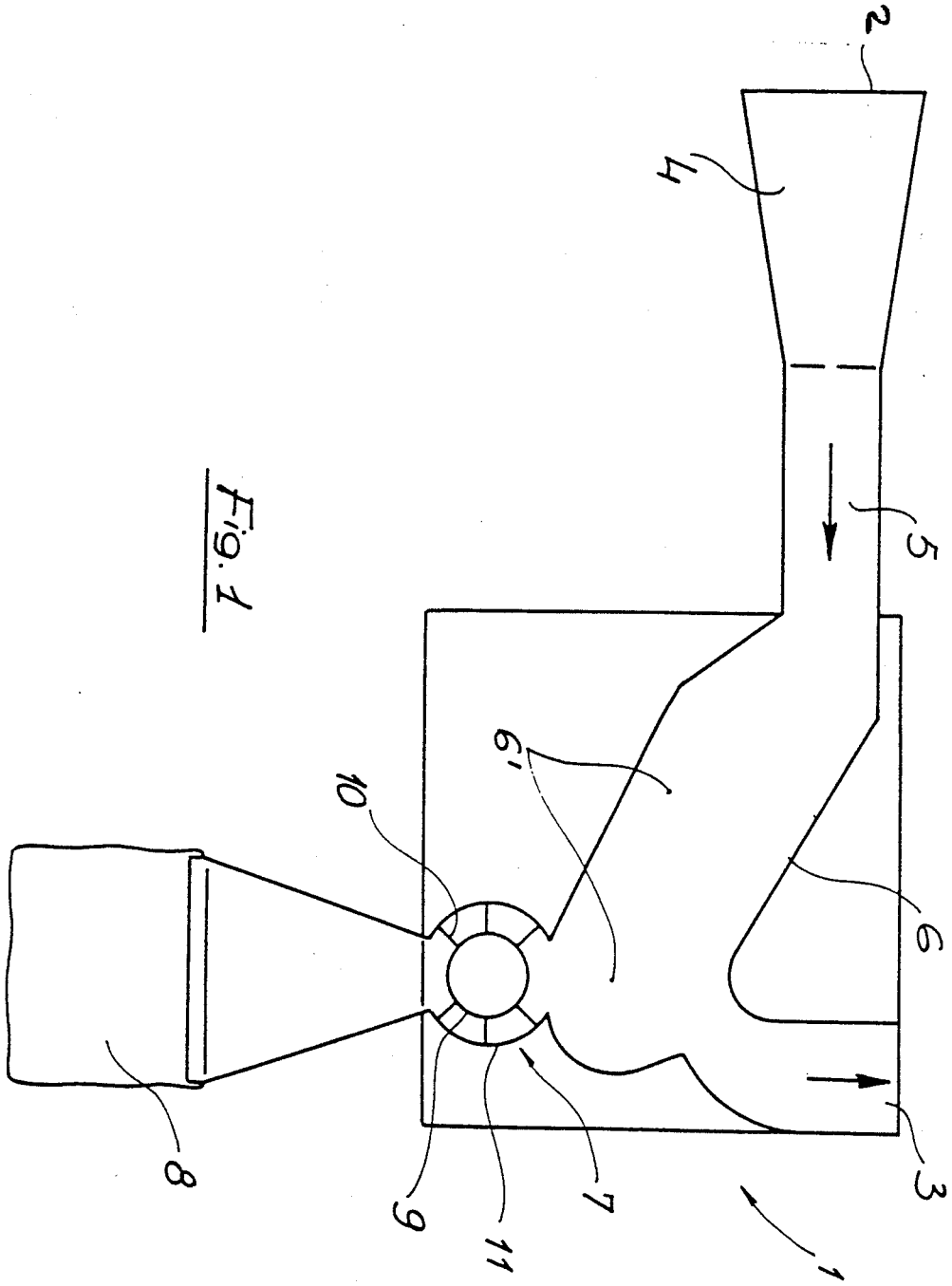
FIG. 1 is a schematic view of the impurity separator according to the invention.

With reference to the figures of the accompanying drawing, the impurity separator for cleaning staple cotton or the like textile material according to the present invention, which has been indicated at the reference number 1, comprises a contaminated cotton material sucking duct 2 extending from a cotton staple processing apparatus therefrom cotton staples are air conveyed to a clean cotton staple delivery vertical duct 3 coupled to a further cotton processing apparatus downward arranged.

As shown, this sucking duct is provided with a converging cross-section portion 4, followed by a constant cross-section portion 5 opened communicating with an end portion of a collecting box 6.

This collecting box has a downward slanted axis and, at an intermediate end thereof is coupled to the mentioned delivery duct 3, whereas, at a bottom end thereof, said collecting box communicates, through a rotary device 7, with a collecting chamber 8. As shown, the end of the box 6 communicating with the portion 5 is arranged at a higher level than the end of the box 6 communicating with the duct 3.

More specifically, the device 7 consists of a rotary wheel 9, which is rotated with a comparatively low angular speed, and being provided with radial blades 10 tangentially sliding with respect to the surface of a cylindrical housing 11.

In operation, the air flow generated between the suction duct 2 and delivery side 3, which entrains staple cotton materials, will form uncontrolled vortex patterns, due to the specifically designed shape of the box 6 and having a maximum intensity at the bottom portion 6' of said box.

Accordingly, the comparatively high weight fibres, which weight depends on the inclusion of not spinnable materials, will tend to be downward displaced and transferred near the device 7.

In this connection, it should be pointed out that the provision of the mentioned device will cause the low weight cotton staples to be recovered by the air vortex and conveyed to the main air flow, directed toward the delivery duct 3.

That same device, on the other hand, will prevent any not spinnable materials conveyed to the collecting chamber 8 from being recirculated.

While the invention has been disclosed and illustrated with reference to a preferred embodiment thereof, it should be apparent that the disclosed embodiment is susceptible to several modifications and variations all of which will come within its scope and spirit.

We claim:

1. An impurity separator for cleaning staple cotton comprising a cotton staple delivery duct including a tapering inlet duct portion and a rectilinear constant cross-section duct portion, a downward slanted box member having a top open end communicating with said constant cross-section duct portion a bottom open end and an intermediate open end, a cleaned staple cotton delivery vertical duct communicating with said intermediate open end of said box member and an unspinnable waste material removing device, said device including a housing encompassing a rotary blade wheel, said housing having an open top communicating with said bottom open end of said box member and an open bottom communicating with an unspinnable waste collecting chamber, said top open end of said box member being arranged at a higher level than said intermediate open end thereof.

* * * * *